US005389431A

United States Patent [19]

Yamasaki

[11] Patent Number: 5,389,431

[45] Date of Patent: Feb. 14, 1995

[54] NONWOVEN FABRIC AND PROCESS FOR PRODUCING SAME

[75] Inventor: Komei Yamasaki, Sodegaura, Japan

[73] Assignee: Idemitsu Kosan Co., Ltd., Tokyo, Japan

[21] Appl. No.: 960,352

[22] PCT Filed: May 12, 1992

[86] PCT No.: PCT/JP92/00601

§ 371 Date: Jan. 7, 1993

§ 102(e) Date: Jan. 7, 1993

[87] PCT Pub. No.: WO92/20850

PCT Pub. Date: Nov. 26, 1992

[30] Foreign Application Priority Data

May 14, 1991 [JP] Japan ..... 3-107894

[51] Int. Cl.[6] ..... D04H 1/42; D04H 1/72

[52] U.S. Cl. ..... 428/288; 156/62.4; 264/500; 264/517; 264/518; 264/205

[58] Field of Search ..... 428/288; 156/62.4; 264/205, 500, 517, 518

[56] References Cited

U.S. PATENT DOCUMENTS 4,219,512 8/1980 Sinn et al. .
5,021,288 6/1991 Jezic ..... 428/224
5,079,075 1/1992 Yamasaki et al. .
5,156,797 10/1992 Yamasaki et al. ..... 264/518
5,166,238 11/1992 Nakano et al. ..... 524/120

FOREIGN PATENT DOCUMENTS 0291915 11/1988 European Pat. Off. .
0312976 4/1989 European Pat. Off. .
0348829 1/1990 European Pat. Off. .
0380968 8/1990 European Pat. Off. .
0430109 6/1991 European Pat. Off. .
53-52726 5/1978 Japan .
2-14055 1/1990 Japan .
2-53909 2/1990 Japan .

*Primary Examiner*—James C. Cannon
*Attorney, Agent, or Firm*—Oblon, Spivak, McClelland, Maier & Neustadt

[57] ABSTRACT

There are disclosed a nonwoven fabric comprising fibrillated three-dimensional network fibers prepared by the use of a styrenic polymer having a high degree of syndiotactic configuration as the pricipal component and also a process for producing the above nonwoven fabric comprising flash-spinning a homogeneous solution containing a styrenic polymer having a high degree of syndiotactic configuration.

The resultant nonwoven fabric is excellent in heat resistance, dimensional stability and solvent resistance.

4 Claims, No Drawings

NONWOVEN FABRIC AND PROCESS FOR PRODUCING SAME

TECHNICAL FIELD

The present invention relates to a nonwoven fabric. More particularly, it pertains to a nonwoven fabric which is excellent in heat resistance, heat resistant dimensional stability and solvent resistance and is suitable for industrial filters, electrical insulating materials, thermal insulating materials and the like; and a process for producing the same.

BACKGROUND ART

In general, a styrenic polymer having syndiotactic configuration (SPS) is known to have high resistance to heat and solvent and there is disclosed a fiber or fabric made of such SPS by melt spinning method or gel orientation method. However, in the case of preparing a nonwoven fabric by melt spinning method, it has been necessary to spin a molten resin extruded from dies at a high speed or to carry out orientation and heat treatment by an appropriate method after spinning the resin for the purpose of enhancing the crystallinity of the SPS, thereby making it difficult to continuously produce a nonwoven fabric. In addition, the gel orientation method has suffered the disadvantage of its low productivity.

There are also publicly known nonwoven fabrics made of polyethylene and polypropylene, respectively by flash spinning method, which however are not sufficient in heat resistance. Under such circumstances, a nonwoven fabric that is further enhanced in heat resistance has been desired.

DISCLOSURE OF THE INVENTION

In order to solve the above-mentioned problems, it has been found by the present inventors that a nonwoven fabric excellent in heat resistance, dimensional stability and solvent resistance is obtained by means of flash spinning of SPS. Specifically, the present invention provide a nonwoven fabric comprising fibrillated there-dimensional network fibers prepared by the use of a high degree SPS as the principal component, and at the same time, a process for producing the aforesaid nonwoven fabric which comprises flash-spinning a homogeneous SPS-containing solution.

THE MOST PREFERRED EMBODIMENT TO CARRY OUT THE INVENTION

The high degree SPS to be used in the present invention means that its stereochemical structure is of a high degree of syndiotactic configuration, i.e. the stereostructures in which phenyl groups or substituted phenyl groups as side chains are located alternately at opposite directions relative to the main chain consisting of carbon-carbon bonds. Tacticity is quantitatively determined by the nuclear magnetic resonance method ($^{13}$C-NMR method) using carbon isotope. The tacticity as determined by the $^{13}$C-NMR method can be indicated in terms of proportions of a plurality of structural units continuously connected to each other, i.e., a diad in which two structural units are connected to each other, a triad in which three structural units are connected to each other and a pentad in which five structural units are connected to each other. "The high degree SPS as mentioned in the present invention usually means polystyrene, poly(alkylstyrene), poly(halogenated styrene), poly(alkoxystyrene), poly(vinyl benzoate), poly(-halogenated alkylstyrene), hydrogenated polymer thereof, the mixture thereof, and copolymers containing the above polymers as main components, having such a syndiotacticity as determined by the above-mentioned method that the proportion of racemic diad is at least 75%, preferably at least 85%, or the proportion of racemic pentad is at least 30%, preferably at least 50%. Examples of the poly(alkylstyrene) include poly(methylstyrene), poly(p-methylstyrene), poly(m-methylstyrene), poly(ethylstyrene), poly(isopropylstyrene), poly(p-tert-butylstyrene) and poly(tert-butylstyrene). Example of the poly(halogenated styrene) include poly(-chlorostyrene), poly(p-chlorostyrene), poly(m-chlorostyrene), poly(bromostyrene), poly(fluorostyrene) and poly(p-fluorostyrene). Examples of the poly(alkoxystyrene) include poly(methoxystyrene) and poly(ethoxystyrene). Example of the poly(vinyl benzoate) include poly(vinylnaphthalene) and poly(vinylstyrene). Examples of the poly(halogenated alkylstyrene) include poly(chloromethylstyrene).

The particularly desirable styrenic polymers are polystyrene, poly(p-methylstyrene), poly(m-methylstyrene), poly(p-tert-butylstyrene), poly(p-chlorostyrene), poly(m-chlorostyrene), poly(p-fluorostyrene), hydrogenated polystyrene and the copolymer containing the structural units thereof.

The molecular weight of the SPS to be used in the present invention is desirably 10,000 or more and 10,000,000 or less, optimally in the range of 50,000 to 5,000,000 in terms of weight-average molecular weight. A weight-average molecular weight of less than 10,000 results in failure to produce uniform fibers and also decrease in heat resistance, whereas that exceeding 10,000,000 leads to a high melt viscosity and difficulty in spinning.

The molecular-weight distribution, that is, the broadening of molecular weight of the SPS is not specifically limited as well, but may be in a wide range, particularly desirably from 1.8 to 10 expressed in terms of the ratio of weight-average molecular weight to number-average molecular weight.

Having a melting point in the rage of 160° to 310° C., the high degree SPS is surpassingly superior to the conventional styrenic polymer having atactic configuration in terms of heat resistance.

Such high degree SPS can be produced by a publicly known process.

The nonwoven fabric according to the present invention comprises fibrillated three-dimensional network fibers prepared from the above-mentioned SPS as the principal component. In the case where a styrenic polymer other than SPS is used, the resultant fabric is inferior to the SPS in resistance to heat and solvent, the non-fibrillated nonwoven fabric loses flexibility, thus causing brittleness because of insufficient orientation, and the fibers of a structure other than three-dimensional network lack heat resistance and dimensional stability at an elevated temperature.

The nonwoven fabric according to the present is that as described herein-before and can be produced by any of various processes without specific limitation.

Examples of the production processes include a process in which the above-mentioned SPS is extruded as such by the conventional method and cooled into fibers, which are then made into a nonwoven fabric, said process being capable of producing a nonwoven fabric having resistance to heat and solvent to some extent. However, as one of preferable exmples for the purpose of obtaining a nonwoven fabric further excellent in heat resistance, heat resistant dimensional stability, solvent resistance and whiteness, there can be exemplified by flash spinning of a homogeneous solution containing the high degree SPS.

The concentration of the SPS in the aforementioned homogeneous solution is generally 1 to 80%, desirably 5 to 60%, more desirably 7 to 55% each by weight. A concentration of the SPS lower than 1% by weight brings about a remarkable decrease in productivity thereof, whereas that higher than 80% by weight gives rise to an extremely viscous solution causing a decrease in fluidity of the polymer solution, thereby making it difficult to produce strong flashing power and attain a spinning velocity sufficient for assuring high-quality fibrillated fibers that are excellent in strength and configuration.

The solvent to be employed in the above-mentioned homogeneous solution is not specifically limited, but may be a conventional publicly known solvent insofar as it is usable for flash spinning. A preferable solvent is, however, a solvent or a mixed solvent which boils at a temperature lower than the melting point of the styrenic polymer by at least 25° C. and further forms a homogeneous solution at the boiling temperature thereof and at the autogenous vapor pressure or a pressure higher than the same. Such solution need not be homogeneous at room temperature. A homogeneous solution of a polymer in a proper solvent is formed usually at temperatures higher than the normal boiling point of the above-mentioned solvent or mixed solvent.

Examples of the usable solvents include an aromatic hydrocarbon such as benzene and toluene; an aliphatic hydrocarbon such as butane, pentane, hexane, heptane, octane and isomers and homologues thereof; an alicyclic hydrocarbon such as cyclohexane; a chlorinated hydrocarbon such as methylene chloride, carbon tetrachloride, chloroform, ethyl chloride and methyl chloride; an alcohol; an ester; an ether; a ketone; a nitrile amide; a halogenated hydrocarbon such as a fluorinated hydrocarbon, CFC 11(trichlorofluorormethane), CFC 113(1,1,2-trichloro-1,2,2-trifluoroethane), HCFC 22 (chlorodifluoromethane), HCFC 123(1,1-dichloro-2,2,2-trifluoroethane), HCFC 141*b*(1,1-dichloro-1-fluoroethane), HCF 134*a*(1,1,1,2-tetrafluoroethane); and a mixture of the above-exemplified solvents. Among them, an incombustible halogenated hydrocarbon is preferable from the viewpoint of safety in handling.

The conditions for preparing such a homogeneous solution depend on the solvent to be used, working temperature and working pressure and therefore, can not be specifically defined, but may be exemplified by the conditions including a temperature of 185° C. and a pressure of 58 kg/cm$^2$G in the case of Flon 113 at a concentration of 15% by weight.

In the case of flash spinning such a homogeneous solution, there are available publicly known methods exemplified by a method wherein a homogeneous solution is depressured into a heterogeneous solution followed by flashing (e.g. Japanese Patent Publication No. 28125/1965) and a method wherein a homogeneous solution is made to tremble followed by flashing (e.g. Japanese Patent Application Laid-Open No. 111,009/1989). In the case of flash spinning, a high spinning velocity (2000 m/min or higher) is desirable so that the fibers comprising SPS are highly oriented and crystallized by orientation, and is materialized by increasing the pressure loss at the time of flash spinning.

As mentioned hereinbefore, the fibrillated three-dimentional network fibers of SPS can be produced by flash spinning.

The above-obtained nonwoven fabric has a fusion enthalpy ($\Delta H_f$) of 28 J/g or more, preferably 30 J/g or more as determined by the use of a differential scanning calorimeter (DSC). A fusion enthalpy thereof less than 28 J/g results in failure to sufficiently exert the characteristics of the SPS including heat resistance and dimensional stability at elevated temperatures.

A thermoplastic resin other than the SPS may be added to the SPS to such an extent that the flash spinning is possible. There are preferably used, for example, a blend of the SPS with polyethylene, polypropylene and/or atctic polystyrene to improve thermal fusion-bonding, a blend of the SPS with polyphenylene ether (PPO) to enhance the strength and the like blend.

Moreover in order to supress the deterioration of the SPS in a solution, an antioxidant may be added to the SPS. Examples of the usable antioxidant include phenol-based, sulfur-based and phosphorus-based ones, which are disclosed in Japanese Patent Application Laid-Open Nos. 284244/1988 or 240548/1989 and to be used alone or in combination with at least one of them.

As the production equipment to be used for flash-spinning the above-mentioned SPS, there are available publicly known techniques and equipment without specific limitation that are disclosed, for example, in Japanese patent Publication No. 28725/1965, Japanese Patent Application Laid-Open Nos. 33816/1987 and 104814/1989, etc.

In the following, the present invention will be described with reference to examples and comparative examples.

PREPARATION EXAMPLE 1

(Preparation of Contact Product of Trimethylaluminum with Water)

In a 500 ml glass vessel which had been purged with argon were placed 17.8 g (71 mmol) of copper sulfate pentahydrate ($CuSO_4.5H_2O$), 200 ml of toluene, and 24 ml (250 mmol) of trimethylaluminum, which were then reacted at 40° C. for 8 hours. Then, the solids were separated from the reaction mixture and the toluene was distilled away from the solution as obtained above under reduced pressure to produce 6.7 g of a contact product. The molecular weight thereof as determined by the freezing point depression method was 610.

PREPARATION EXAMPLE 2

In a 2 L (L=liter) reaction vessel were placed 1 L of purified styrene, the contact product as obtained in the above Preparation Example 1 in an amount of 5 mmol as aluminum atom, 5 mmol of triisobutylaluminum and 0.025 mmol of pentamethylcyclopentadienyltitanium trimethoxide, which were then subjected to polymerization reaction at 90° C. for 5 hours. After the completion of the reaction, the catalytic components were decomposed with a solution of sodium hydroxide in methanol and then the reaction product was washed with methanol repeatedly and dried to afford 308 g of polymer. As the result of analysis by gel permeation chromatography using 1,2,4-trichlorobenzene at 135° C. as the solution, the polymer thus produced had a weight-average molecular weight of 389,000 and a ratio of weight-average molecular weight to number-average molecular weight of 2.64.

It was confirmed that the polymer was SPS from the results of melting point measurement and $^{13}$C-NMR analysis.

PREPARATION EXAMPLE 3

In a 2 L reaction vessel were placed 1 L of purified styrene, the contact product as obtained in the above Preparation Example 1 in an amount of 5 mmol as aluminum atom, 7.3 mmol of triisobutylaluminum and 0.038 mmol of pentamethylcyclopentadienyltitanium trimethoxide, which were then subjected to polymerization reaction at 50° C. for 2 hours. After the completion of the reaction, the catalytic components were decomposed with a solution of sodium hydroxide in methanol and then the reaction product was washed with methanol repeatedly and dried to afford 625 g of polymer. As the result of analysis by gel permeation chromatography using 1,2,4-trichlorobenzene at 135° C. as the solution, the polymer thus produced had a weight-average molecular weight of 1,086,000 and a ratio of weight-average molecular weight to number-average molecular weight of 2.81.

It was confirmed that the polymer was SPS from the results of melting point measurement and $^{13}$C-NMR analysis.

PREPARATION EXAMPLE 4

In a 2 L reaction vessel were placed 1 L of purified styrene, the contact product as obtained in the above Preparation Example 1 in an amount of 5 mmol as aluminum atom, 2.5 mmol of triisobutylaluminum and 0.025 mmol of pentamethylcyclopentadienyltitanium trimethoxide, which were then subjected to polymerization reaction at 40° C. for 2 hours. After the completion of the reaction, the catalytic components were decomposed with a solution of sodium hydroxide in methanol and then the reaction product was washed with methanol repeatedly and dried to afford 388 g of polymer. As the result of analysis by gel permeation chromatography using 1,2,4-trichlorobenzene at 135° C. as the solution, the polymer thus produced had a weight-average molecular weight of 2,950,000 and a ratio of weight-average molecular weight to number-average molecular weight of 2.61.

It was confirmed that the polymer was SPS from the results of melting point measurement and $^{13}$C-NMR analysis.

PREPARATION EXAMPLE 5

In a 2 L reaction vessel were placed 1 L of purified styrene, the contact product as obtained in the above Preparation Example 1 in an amount of 7.5 mmol as aluminum atom, 7.3 mmol of triisobutylaluminum and 0.038 mmol of pentamethylcyclopentadienyltitanium trimethoxide, which were then subjected to polymerization reaction at 90° C. for 5 hours. After the completion of the reaction, the catalytic components were decomposed with a solution of sodium hydroxide in methanol and then the reaction product was washed with methanol repeatedly and dried to afford 466 g of polymer. As the result of analysis by gel permeation chromatography using 1,2,4-trichlorobenzene at 135° C. as the solution, the polymer thus produced had a weight-average molecular weight of 290,000 and a ratio of weight-average molecular weight to number-average molecular weight of 2.72.

It was confirmed that the polymer was SPS from the results of melting point measurement and $^{13}$C-NMR analysis.

PREPARATION EXAMPLE 6

In a 2 L reaction vessel were placed 965 ml of purified styrene, 35 ml of p-methylstyrene, the contact product as obtained in the above Preparation Example 1 in an amount of 7.5 mmol as aluminum atom, 7.5 mmol of triisobutylaluminum and 0.038 mmol of pentamethylcyclopentadienyltitanium trimethoxide, which were then subjected to polymerization reaction at 90° C. for 5 hours. After the completion of the reaction, the catalytic components were decomposed with a solution of sodium hydroxide in methanol and then the reaction product was washed with methanol repeatedly and dried to afford 308 g of polymer. As the result of analysis by gel permeation chromatography using 1,2,4-trichlorobenzene at 135° C. as the solvent, the polymer thus produced had a weight-average molecular weight of 440,000 and a ratio of weight-average molecular weight to number-average molecular weight of 2.52. The polymer had a melting point of 250° C. and a proportion of p-methylstyrene units in the copolymer of 7 mol %. In addition, from the result of $^{13}$C-NMR analysis for the aforementioned copolymer, absorptions were observed at 145.11 ppm, 145.22 ppm and 142.09 ppm, and the syndiotacticity of the styrenic units in terms of racemic pentad as calculated from the peak area thereof was 72%.

EXAMPLE 1

The SPS powder as obtained in Preparation Example 2 in an amount of 200 g was placed in a high-pressure autoclave of about 800 cm$^3$ in volume. After deaerating, 600 g of trifluoromethane was put into the autoclave to dissolve the SPS powder under stirring, heating and pressurizing, thereby forming a homogeneous solution of SPS having a concentration of 25% by weight at a temperature of 185° C.

Then, the stirring was stopped, a back pressure was applied to maintain the internal pressure in the autoclave at at 250 kg/cm$^2$, the discharge valve at the bottom thereof was opened to introduce the solution into the depressurizing chamber through a depressurizing orifice and the solution was discharged into the atmosphere through spinnerets to carry out flash spinning. The fibers thus obtained developed an appearance of collected fibrils of opaque pure-white color and were confirmed to be the fibers with three-dimensional network by microscipic observation.

The results obtained are given in Table 1.

EXAMPLE 2

The SPS powder as obtained in Preparation Example 3 in an amount of 150 g that was incorporated with 0.15 g of IRGANOX 1010 (produced by Ciba-Geigy) as the antioxidant was placed in a high-pressure autoclave same as that used in Example 1. After deaerating, 600 g of trifluoromethane was put into the autoclave to dissolve the SPS powder under stirring, heating and pressurizing, thereby forming a homogeneous solution of SPS having a concentration of 20% by weight at a temperature of 185° C.

Then, the stirring was stopped, a back pressure was applied to maintain the internal pressure in the autoclave at 280 kg/cm$^2$, the discharge valve at the bottom thereof was opened to introduce the solution into the depressurizing chamber and the solution was subjected to flash spinning.

The results obtained are given in Table 1.

EXAMPLE 3

The SPS powder as obtained in Preparation Example 4 in an amount of 67 g that was incorporated with 0.07 g of IRGANOX 1010 (produced by Ciba-Geigy) as the antioxidant was placed in a high-pressure autoclave same as that used in Example 1. After deaerating, 600 g of trifluoromethane was put into the autoclave to dissolve the SPS powder under stirring, heating and pressurizing, thereby forming a homogeneous solution of SPS having a concentration of 10% by weight at a temperature of 195° C.

Then, the stirring was stopped, a back pressure was applied to maintain the internal pressure in the autoclave at 300 kg/cm$^2$, the discharge valve at the bottom thereof was opened to introduce the solution into the depressurizing chamber and the solution was subjected to flash spinning.

The results obtained are given in Table 1.

EXAMPLE 4

The SPS powder as obtained in Preparation Example 2 in an amount of 106 g that was incorporated with 0.11 g of IRGANOX 1010 (produced by Ciba-Geigy) as the antioxidant was placed in a high-pressure autoclave same as that used in Example 1. After deaerating, 600 g of trifluoromethane was put into the autoclave to dissolve the SPS powder under stirring, heating and pressurizing, thereby forming a homogeneous solution of SPS having a concentration of 15% by weight at a temperature of 185° C.

Then, the stirring was stopped, a back pressure was applied to maintain the internal pressure in the autoclave at 120 kg/cm$^2$, the discharge valve at the bottom thereof was opened to introduce the solution into the depressurizing chamber and the solution was subjected to flash spinning.

The results obtained are given in Table 1.

EXAMPLE 5

The SPS powder as obtained in Preparation Example 5 in an amount of 1,000 g that was incorporated with 0.1% by weight of IRGANOX 1010 (produced by Ciba-Geigy) as the antioxidant was pelletized by the use of an extruder that was set to 290° C. The pellet thus obtained had a weight-average molecular weight of 245,000 and weight-average molecular weight/number-average molecular weight ratio of 2.65.

The pellet thus obtained in an amount of 600 g was placed in a high-pressure autoclave same as that used in Example 1. After deaerating, 600 g of trifluoromethane was put into the autoclave to dissolve the SPS pellet under stirring, heating and pressurizing, thereby forming a homogeneous solution of SPS having a concentration of 50% by weight at a temperature of 190° C.

Then, the stirring was stopped, a back pressure was applied to maintain the internal pressure in the autoclave at 280 kg/cm$^2$, the discharge valve at the bottom thereof was opened to introduce the solution into the depressurizing chamber and the solution was subjected to flash spinning.

The results obtained are given in Table 1.

EXAMPLE 6

The SPS powder as obtained in Preparation Example 3 in an amount of 66.7 g that was incorporated with 0.7 g of IRGANOX 1010 (produced by Ciba-Geigy) as the antioxidant was placed in a high-pressure autoclave same as that used in Example 1. After deaerating, 600 g of trifluoromethane was put into the autoclave to dissolve the SPS powder under stirring, heating and pressurizing, thereby forming a homogeneous solution of SPS having a concentration of 25% by weight at a temperature of 220° C.

Then, the stirring was stopped, back pressure was applied to maintain the internal pressure in the autoclave at 250 kg/cm$^2$, the discharge valve at the bottom thereof was opened to introduce the solution into the depressurizing chamber and the solution was subjected to flash spinning.

The results obtained are given in Table 1.

EXAMPLE 7

The nonwoven fabric as obtained in Example 2 was thermally fusion-bonded by the use of an embossing roll that was set to 200° C. to afford an opaque pure-white thermally fusion-bonded nonwoven fabric. The modulus of elasticity (dyne/cm$^2$) of the resultant fabric was measured with a solid viscoelasticity spectrometer (produced by Iwamoto Seisakusho Co., Ltd.). The results obtained are given in Table 2.

COMPARATIVE EXAMPLE 1

Following the procedure in Example 4, the autoclave was set to a temperature of 125° C. and a pressure of 50 kg/cm$^2$, where completely homogeneous solution was not formed with the presence of swollen SPS powders. The solution was subjected to flush spinning in the same manner as in Example 4. However, fibrillated fibers were not obtained, and the resultant nonwoven fabric was devoid of flexibility and readily broken by twist. The results obtained are given in Table 1.

COMPARATIVE EXAMPLE 2

The SPS powder as obtained in Preparation Example 2 was subjected to melt spinning at a die temperature of 310° C. and a spinning velocity of 600 m/min. The fibers thus obtained were translucent linear fibers with 4 denier without three-dimensional network. The results obtained are given in Table 1.

COMPARATIVE EXAMPLE 3

The fibers as obtained in Comparative Example 2 were heat-treated at 230° C. for recrystallization for 10, 60 and 120 minutes, respectively. The recrystallized fibers had each a fusion enthalpy (J/g) of 25.7, 26.1 and 26.1, respectively as determined with a DSC.

Thus it has been proved that the fusion enthalpy of the fibers that were prepared by melt spinning, even if heat treated, is less than that of the flash spun fibers.

COMPARATIVE EXAMPLE 4

The fibers as obtained in Comparative Example 2 were dispersed and thermally bonded under the same conditions as in Example 7 to afford a nonwoven fabric, the modulus of elasticity of which was determined. The results obtained are given in Table 2.

EXAMPLE 8

The procedure in Example 1 was repeated except that 106 g of styrene/p-methylstyrene copolymer as obtained in Preparation Example 6 and 600 g of Flon 113 were used and the temperature of the solution was 180° C. A back pressure was applied to maintain the internal pressure in the autoclave at 250 kg/cm$^2$. The results obtained by flash spinning are given in Table 1.

TABLE 1

| No. | Weight-average molecular weight | SPS concentration (% by weight) | Solvent | Dissolving condition temperature (°C.) | Dissolving condition pressure (kg/cm$^2$) |
|---|---|---|---|---|---|
| Example 1 | 389000 | 25 | trichlorofluoromethane | 185 | 250 |
| Example 2 | 1086000 | 20 | trichlorofluoromethane | 185 | 280 |
| Example 3 | 2950000 | 10 | trichlorofluoromethane | 195 | 300 |
| Example 4 | 389000 | 15 | trichlorofluoromethane | 185 | 120 |
| Example 5 | 245000 | 50 | trichlorofluoromethane | 190 | 280 |
| Example 6 | 245000 | 25 | cyclohexane | 220 | 250 |
| Comparative Example 1 | 389000 | 15 | trichlorofluoromethane | 125 | 50 |
| Comparative Example 2 | 389000 | | melt spinning | | |
| Example 8 | 440000 | 15 | Flon 113 | 180 | 250 |

| No. | $\Delta H_f$ (J/g) | State of nonwoven fabric |
|---|---|---|
| Example 1 | 37.1 | three-dimensional network, opaque white color |
| Example 2 | 39.5 | three-dimensional network, opaque white color |
| Example 3 | 38.7 | three-dimensional network, opaque white color |
| Example 4 | 33.5 | three-dimensional network, opaque white color |
| Example 5 | 36.4 | three-dimensional network, opaque white color |
| Example 6 | 37.1 | three-dimensional network, opaque white color |
| Comparative Example 1 | 27.2 | lamella, brittle |
| Comparative Example 2 | 16.4 | linear fiber, opaque white color |
| Example 8 | 36.5 | three-dimensional network, opaque white color |

TABLE 2

| | | Modulus of elasticity (dyne/cm$^2$) Example 7 | Modulus of elasticity (dyne/cm$^2$) Comparative Example 4 |
|---|---|---|---|
| Measurement temperature | 30° C. | $5.2 \times 10^{10}$ | $4.0 \times 10^{10}$ |
| | 80° C. | $4.8 \times 10^{10}$ | $3.5 \times 10^{10}$ |
| | 100° C. | $2.5 \times 10^{10}$ | $9.6 \times 10^{9}$ |
| | 120° C. | $1.1 \times 10^{10}$ | $1.6 \times 10^{9}$ |
| | 200° C. | $7.2 \times 10^{9}$ | $9.8 \times 10^{8}$ |
| | 250° C. | $6.8 \times 10^{9}$ | $9.2 \times 10^{8}$ |

COMPARATIVE EXAMPLE 5

The procedure in Comparative Example 2 was repeated to prepare the fibers except that a spinning velocity of 2000 m/min was applied. The resultant fibers were translucent linear fibers having a fusion enthalpy of 31 J/g as determined with a DSC.

EXAMPLES 9, 10 AND 11 AND COMPARATIVE EXAMPLES 6 AND 7

The fibers obtained in Examples 2, 4 and 8 and Comparative Examples 6 and 7 were each placed in an oven at 250° C., and the thermal shrinkage rate of each of the fibers was determined on the basis of the original fiber length of 30 cm. The results are given in Table 3.

TABLE 3

| No. | Fiber used | Thermal shrinkage rate (%)* 1 minute heat treatment | Thermal shrinkage rate (%)* 10 minutes heat treatment |
|---|---|---|---|
| Example 9 | Example 2 | 0 | 2 |
| Example 10 | Example 4 | 0 | 3 |
| Example 11 | Example 8 | 0 | 3 |
| Comparative Example 6 | Comparative Example 2 | 44 | 48 |
| Comparative Example 7 | Comparative Example 5 | 5 | 8 |

$$\text{*Thermal shrinkage rate (\%)} = \frac{30 - \text{fiber length after heat treatment}}{30} \times 100$$

INDUSTRIAL APPLICABILITY

As described hereinbefore, the nonwoven fabric according to the present invention is excellent in heat resistance, heat resistant dimensional stability and solvent resistance as compared with the conventional nonwoven fabrics.

Accordingly, the nonwoven fabric according to the present invention is expected to find a wide variety of effective use as medical fabrics, industrial filters, cell separators, electrical insulating materials, thermal insulating materials and the like.

I claim:

1. A nonwoven fabric which comprises fibrillated three-dimensional network fibers comprising, as a principal component, fibers prepared by flash-spinning a styrenic polymer having a high degree of syndiotactic configuration.

2. The nonwoven fabric according to claim 1 wherein said fabric has a fusion enthalpy of 28 J/g or more as determined with a differential scanning calorimeter.

3. A process for producing the nonwoven fabric as set forth in claim 1 which comprises flash-spinning a homogeneous solution containing a styrenic polymer having a high degree of syndiotactic configuration.

4. The process according to claim 3 wherein the concentration of the styrenic polymer having a high degree of syndiotactic configuration in the homogeneous solution is in the range of 1 to 80% by weight.

* * * * *